US007581412B2

(12) United States Patent
Kim et al.

(10) Patent No.: US 7,581,412 B2
(45) Date of Patent: Sep. 1, 2009

(54) TILTED DRUM TYPE WASHING MACHINE

(75) Inventors: Jong Seok Kim, Changwon-si (KR); Yang Hwan No, Changwon-si (KR); Han Ki Cho, Changwon-si (KR); Yeon Su Jung, Changwon-si (KR); Jung Hoon Kang, Changwon-si (KR); Myung Sik Park, Changwon-si (KR); Young Hoon Ha, Masan-si (KR)

(73) Assignee: LG Electronics Inc., Seoul (KR)

( * ) Notice: Subject to any disclaimer, the term of this patent is extended or adjusted under 35 U.S.C. 154(b) by 299 days.

(21) Appl. No.: 10/720,150

(22) Filed: Nov. 25, 2003

(65) Prior Publication Data

US 2004/0163426 A1 Aug. 26, 2004

(30) Foreign Application Priority Data

Nov. 29, 2002 (KR) ..... 10-2002-0075315

(51) Int. Cl.
*D06F 29/00* (2006.01)
*D06F 35/00* (2006.01)

(52) U.S. Cl. ..... 68/24; 68/5 E; 68/23 A; 68/26

(58) Field of Classification Search ..... 68/24, 68/5 E, 23 A, 36
See application file for complete search history.

(56) References Cited

U.S. PATENT DOCUMENTS

| | | | | |
|---|---|---|---|---|
| 2,613,837 | A * | 10/1952 | Morton | 206/320 |
| 5,860,300 | A * | 1/1999 | Valent | 68/24 |
| 6,256,823 | B1 * | 7/2001 | Kronbetter et al. | 8/158 |
| 6,584,814 | B2 * | 7/2003 | Son et al. | 68/24 |
| 2004/0025544 | A1 * | 2/2004 | Kim et al. | 68/3 R |

* cited by examiner

*Primary Examiner*—Michael Barr
*Assistant Examiner*—Rita R Patel
(74) *Attorney, Agent, or Firm*—Birch, Stewart, Kolasch & Birch, LLP

(57) ABSTRACT

Disclosed is a tilted drum type washing machine, in which an internal structure is improved to prevent a contact between a drum and a lip of a gasket. The present invention includes a cabinet having an entrance at a front side for inputting/outputting a laundry, a door opening/closing the entrance, a tub installed slant in the cabinet to hold water, a drum in the tub to hold a detergent and the water, a gasket between the door and the tub, the gasket bringing the door airtight to prevent the water from leaking outside, a lip on an inner circumference of the gasket to prevent particles from being put in a space between the tub and the drum, and a support member preventing the lip from drooping to prevent an interruption between the lip and the drum. And, the support member includes a reinforcement rib on an inner circumference of the tub to support an inner lateral side of the lip or a protrusion at the inner lateral side of the lip.

19 Claims, 5 Drawing Sheets

TILTED DRUM TYPE WASHING MACHINE

This application claims the benefit of Korean Application(s) No. 10-2002-0075315 filed on Nov. 29, 2002, which is/are hereby incorporated by reference.

BACKGROUND OF THE INVENTION

1. Field of the Invention

The present invention relates to a tilted drum type washing machine, which provides an improved inner structure enabling to prevent a lip at a gasket from being contacted with a drum.

2. Discussion of the Related Art

Generally, the laundry, water, and detergent are put in drum and tub obliquely installed in a tilted drum type washing machine. The drum is then rotated to lift the laundry up by protrusions to perform washing using the shock energy of the laundry falling down and a frictional force thereof.

Such a tilted drum type washing machine avoids causing damage to the laundry and prevents the laundry from being entangled. Moreover, compared to a general drum type washing machine, the tilted drum type washing machine includes the drum that is installed slant so as to be convenient in putting the laundry in the drum.

A construction of a tilted drum type washing machine according to a related art is explained by referring to the attached drawing as follows.

FIG. 1 is a schematic cross-sectional view of a tilted drum type washing machine according to a related art.

Referring to FIG. 1, in a tilted drum type washing machine according to a related art, a cabinet 2 made of a metal-based material forms an exterior. An entrance 3 is formed at a front side of the cabinet 2, and a door 4 is installed at the entrance 3 to open/close.

A tub 14 is installed slant in the cabinet 2 to hold water. A spring 15 and a damper 16 are installed between the tub 14 and the cabinet 2. The spring and 15 damper 16 attenuate vibrations transferred to the tub 14 while the washing machine operates.

A drum 12 in which the laundry and detergent are put is rotatably installed in the tub 14. A rotational shaft 18 coupled to a motor 17 is installed in rear of the drum 12 to transfer a driving force to the drum 12.

Meanwhile, a gasket 20 formed of such an elastic material as rubber is installed between the door 4 and the tub 14. The gasket 20 alleviates a shock generated from a rotation of the drum 12 as well as makes the door 4 airtight to prevent the water from leaking.

And, a lip 25 protruding toward a space between the tub 14 and the drum 12 is formed on an inner circumference of the gasket 20. The lip 25 is built in one body of the gasket 20 and prevents particles from being stuck in the space between the tub 14 and the drum 12.

However, in the related art tilted drum type washing machine, since the gasket is installed slant as well as the tub and drum, the lip comes into drooping inward according to a long time use of the washing machine.

Thus, drooping inward, the lip is brought contact with the rotating drum to result in a failure of the washing machine. Moreover, the drooping lip is easily worn out to reduce its endurance.

SUMMARY OF THE INVENTION

Accordingly, the present invention is directed to a tilted drum type washing machine that substantially obviates one or more of the problems due to limitations and disadvantages of the related art.

An object of the present invention, which has been devised to solve the foregoing problem, lies in providing a tilted drum type washing machine, which prevents a lip from drooping to enhance a product reliance.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a tilted drum type washing machine including a cabinet having an entrance at a front side for inputting/outputting a laundry, a door opening/closing the entrance, a tub installed slant in the cabinet to hold water, a drum in the tub to hold a detergent and the water, a gasket between the door and the tub, the gasket bringing the door airtight to prevent the water from leaking outside, a lip on an inner circumference of the gasket to prevent particles from being put in a space between the tub and the drum, and a support member preventing the lip from drooping to prevent an interruption between the lip and the drum.

In this case, the support member includes a reinforcement rib formed on an inner circumference of the tub to support an inner lateral side of the lip. And, the reinforcement rib can be plurally formed to leave a predetermined interval from each other.

And, the reinforcement rib is formed to leave a predetermined distance from the inner lateral side of the lip or can be built in one body of the tub.

Meanwhile, the support member may include a protrusion formed on an inner lateral side of the lip to be contacted with the tub. The protrusion is formed at a tip of the lip or may be plurally formed to leave a predetermined interval from each other.

Moreover, the protrusion is formed to leave a predetermined distance from the tub or may be built in one body of the lip.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
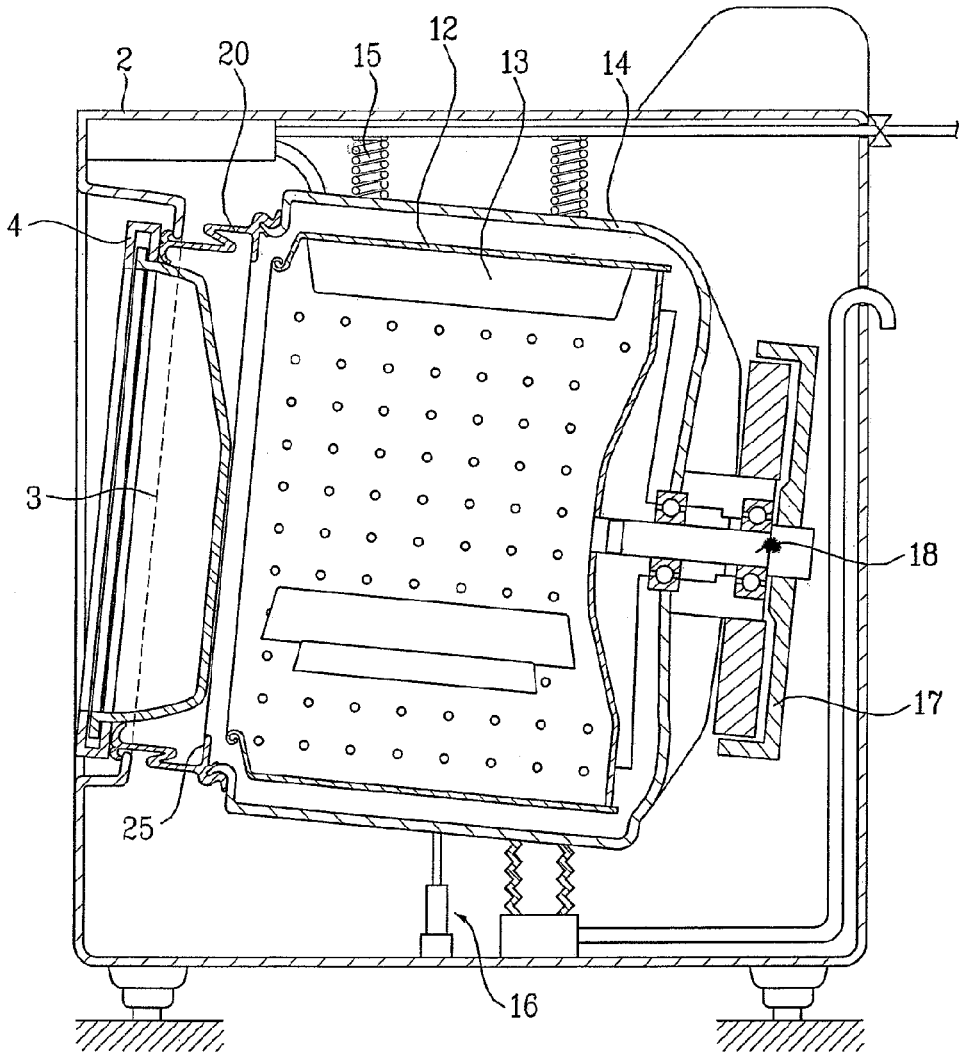
Prior Art FIG. 1
FIG. 1 is a schematic cross-sectional view of a tilted drum type washing machine according to a related art.
Figure 2:
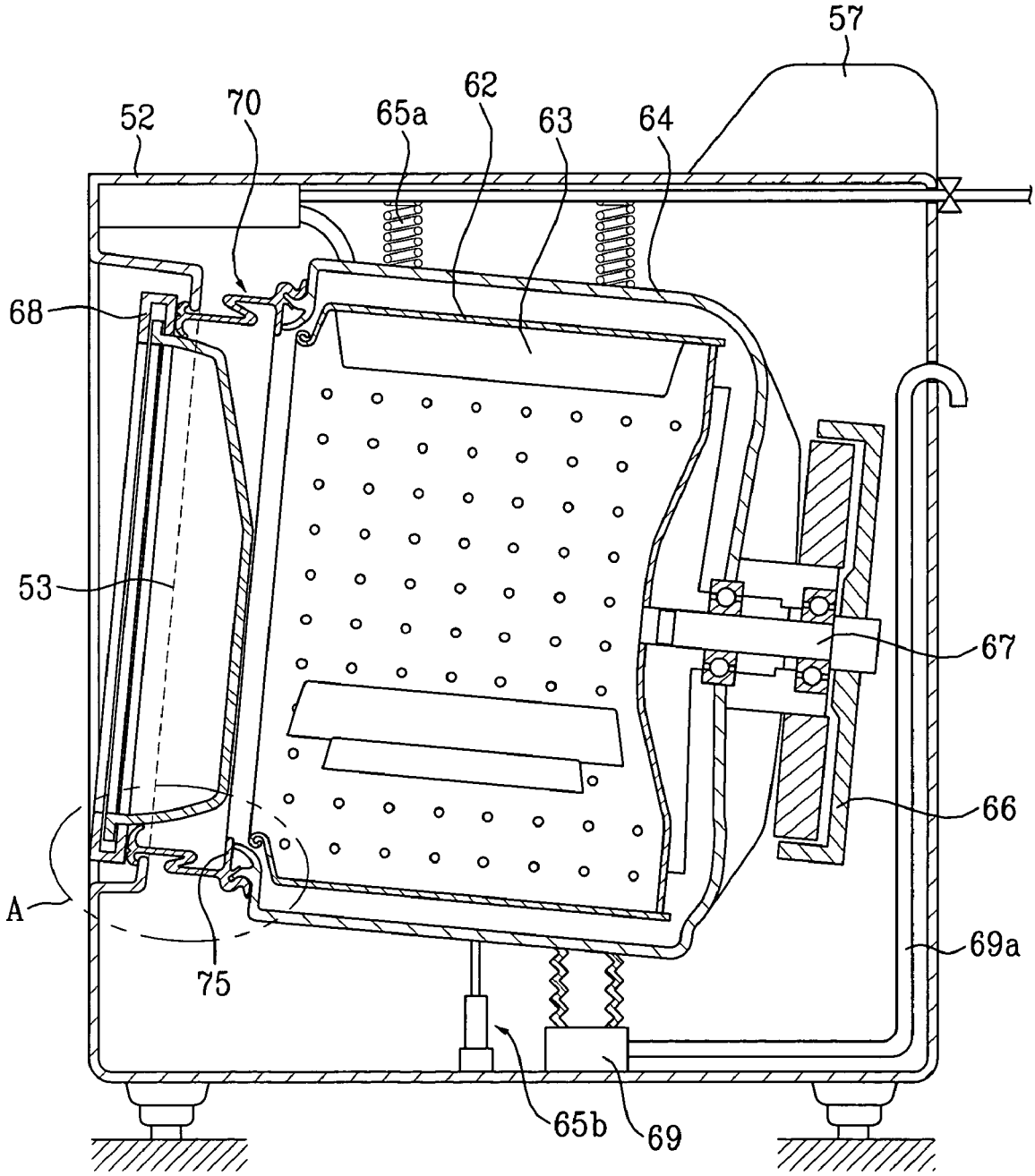
FIG. 2 is a cross-sectional view of a tilted drum type washing machine according to a first embodiment of the present invention.

FIG. 2 is a cross-sectional view of a tilted drum type washing machine according to a first embodiment of the present invention.

Referring to FIG. 2, in a tilted drum type washing machine according to a first embodiment of the present invention, a cabinet 52 having an opening 53 at a front side forms an exterior. The opening 53 is to put in/out a laundry, and a door 68 rotatably installed at the cabinet 52 to open/close the opening 53.

A tub 64 is installed slant in the cabinet 52 to hold water therein, and a drum 62 in which the laundry and detergent are put is rotatably installed in the tub 56.

A plurality of lifts 63 are installed on an inside of the drum 62 to pull up the laundry to a predetermined height to fall. A rotational shaft 67 coupled with a motor 66 is installed in rear of the drum 62 to transfer a driving force to the drum 62. In this case, the rotational shaft 67 penetrates a rear side of the tub 64.

A spring 65*a* is installed between an upper side of the tub 64 and an inner topside of the cabinet 52 to support to suspend the tub 64.

And, a damper 65*a* is installed between a lower side of the tub 64 and an inner bottom side of the cabinet 62 to absorb to alleviate a vibration of the tub 64 which is generated from a rotation of the drum 62 on dewatering.

A control panel 57 for controlling an operation of the tilted drum type washing machine is installed on a top of the cabinet 52. And, a drain pump 69 and a drain hose 69*a* are installed under the tub 64 to discharge the water.

Meanwhile, a gasket 70 formed of such an elastic material as rubber is installed between the door 68 and the tub 64. The gasket 70 absorbs a shock transferred to the tub 64 when the drum 62 rotates as well as prevents the water from leaking through the door 68.

For this, one end of the gasket 20 is coupled to the tub 64 and the other end is coupled to the cabinet 52.

Figure 3:
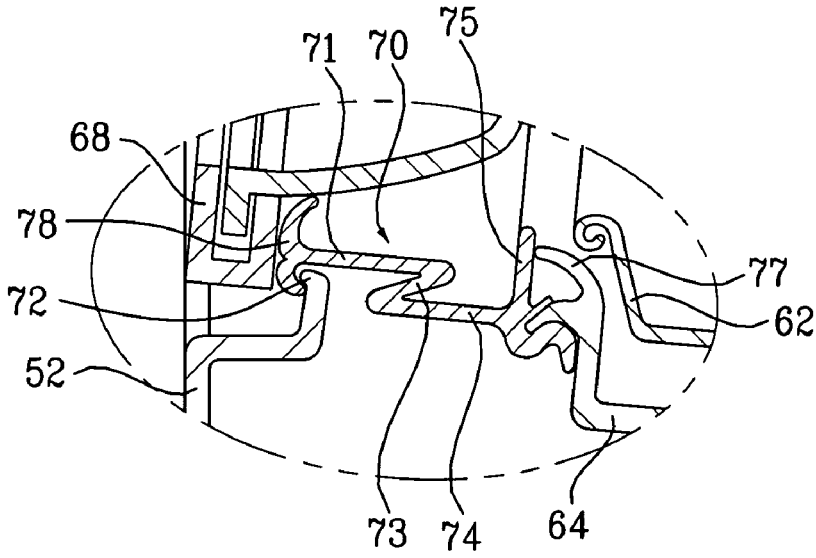
FIG. 3 is a magnified view of a portion 'A' in FIG. 2.

Specifically, the gasket 70, as shown in FIG. 3, includes a first plane portion 71, a second plane portion 74, and a bending portion 73 connecting the first plane portion 71 to the second plane portion 74.

The first plane portion 71 is coupled to the cabinet 52 and has a coupling hook 78 at its tip. The coupling hook 78 is hooked on a coupling groove 72 formed at a circumference of the opening 53 of the cabinet 52, and adheres closely to the door 68 to prevent the water from leaking when the door 68 is closed.

The second plane portion 74 is coupled to the tub 64, and the bending portion 73 is curved between the first and second plane portions 71 and 74 to attenuate the vibration transferred to the tub 64 more effectively.

Moreover, a clamp (not shown in the drawing) is preferably installed on outsides of the first and second plane portions 71 and 74 to securely couple the gasket 70 to the cabinet and tub 52 and 64.

Meanwhile, a lip 75 is formed on an inner circumference of the gasket 70 to protrude toward a space between the tub 64 and the drum 62. The lip 75 is built in one body of the gasket 70 to prevent particles from being put in the space between the tub 64 and the drum 62.

The tilted drum type washing machine according to the present invention includes a support member preventing the lip 75 from drooping to prevent a contact between the lip 75 and the drum 62.

In the tilted drum type washing machine according to the first embodiment of the present invention, the support member, as shown in FIG. 3, includes a reinforcement rib 77 installed on an inner circumference of the tub 64 to support an inner lateral side of the lip 75.

The reinforcement rib 77 may be singly formed long along the inner circumference of the tub 64. Instead, a plurality of reinforcement ribs can be formed to leave a predetermined interval from each other.

The reinforcement rib 77 is formed to be contacted with the inner lateral side of the lip 75. Of course, the reinforcement rib 77 can be formed to leave a predetermined distance from the inner lateral side of the lip 75 to prevent the lip 75 from drooping over a predetermined angle.

And, the reinforcement rib 77 is preferably built in one body of the tub 64.

Figure 4:
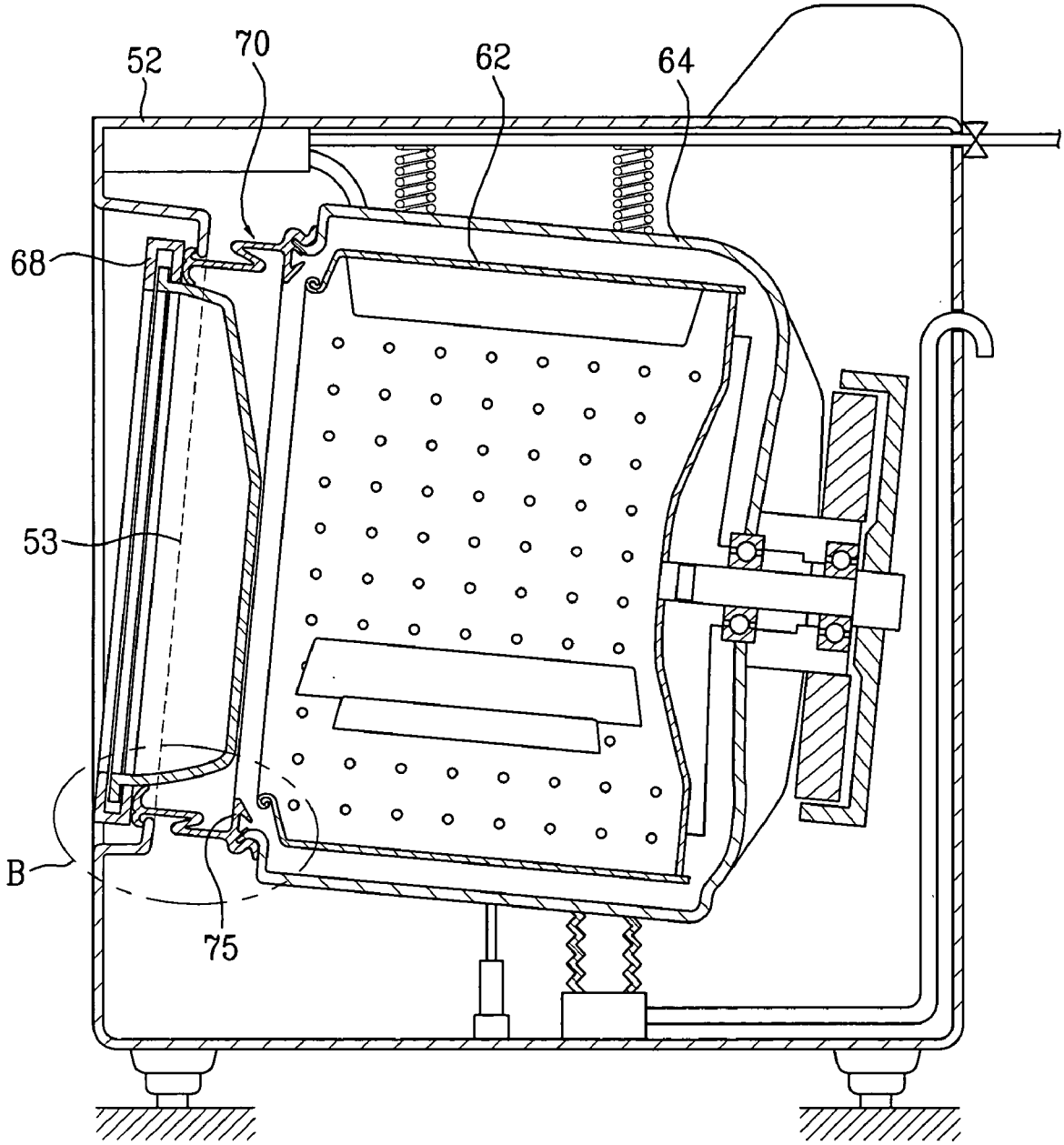
FIG. 4 is a cross-sectional view of a tilted drum type washing machine according to a second embodiment of the present invention.
Figure 5:
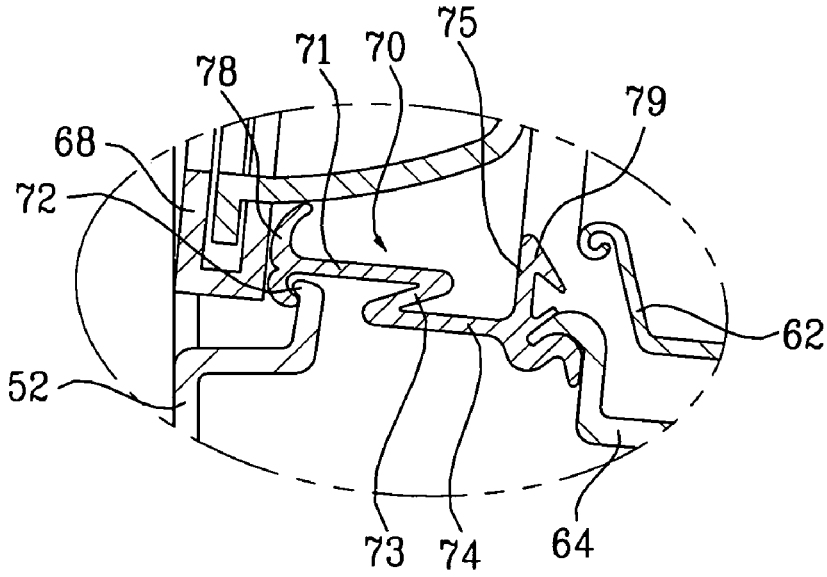
FIG. 5 is a magnified view of a portion 'B' in FIG. 4.

FIG. 4 is a cross-sectional view of a tilted drum type washing machine according to a second embodiment of the present invention and FIG. 5 is a magnified view of a portion 'B' in FIG. 4.

Referring to FIG. 4, a gasket 70 formed of such an elastic material as rubber is installed between the door 68 and the tub 64. The gasket 70 absorbs a shock transferred to the tub 64 when the drum 62 rotates as well as prevents the water from leaking through the door 68.

For this, one end of the gasket 20 is coupled to the tub 64 and the other end is coupled to the cabinet 52.

Specifically, the gasket 70, as shown in FIG. 5, includes a first plane portion 71, a second plane portion 74, and a bending portion 73 connecting the first plane portion 71 to the second plane portion 74.

A detailed description of the above-constructed gasket 70 is as good as that of the first embodiment of the present invention, thereby being skipped in the following.

Meanwhile, a lip 75 is formed on an inner circumference of the gasket 70 to protrude toward a space between the tub 64 and the drum 62. The lip 75 is built in one body of the gasket 70 to prevent particles from being put in the space between the tub 64 and the drum 62.

The tilted drum type washing machine according to the present invention includes a support member preventing the lip 75 from drooping to prevent an interruption between the lip 75 and the drum 62.

In the tilted drum type washing machine according to the second embodiment of the present invention, the support member, as shown in FIG. 5, includes a protrusion 79 formed on an inner circumference of the tub 64 to be contacted with an inner lateral side of the lip 75.

The protrusion 79 may be formed at a central portion or tip of the inner lateral side of the lip 75. The protrusion 79 may be singly formed long along the inner circumference of the tub 64. Instead, a plurality of protrusions can be formed to leave a predetermined interval from each other thereon.

The protrusion 79 can be formed to leave a predetermined distance from the tub 75. In case that the protrusion 79 is formed to leave the predetermined distance from the tub 75, the protrusion 79 is brought contact with the tub 64 to prevent the lip 75 from drooping when the lip 75 droops inward.

And, the protrusion 79 is preferably built in one body of the lip 75.

Accordingly, the tilted drum type washing machine according to the present invention has the following effects or advantages.

First of all, the present invention includes the support member preventing the lip from drooping inward. The support member prevents the interruption between the lip and the drum, thereby preventing the lip from being worn out.

Secondly, the present invention enables to maintain the shape of the lip uniformly to enhance a product reliance.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A tilted drum washing machine comprising:

a cabinet having an entrance at a front side for inputting/outputting laundry;

a door opening/closing the entrance;

a tub slantingly installed in the cabinet to hold water;

a drum in the tub to hold a detergent and the water;

a gasket between the door and the tub, the gasket bringing the door watertight to prevent the water from leaking outside;

a lip extending radially inward from an interior side of the gasket around an inner circumference of the gasket to prevent particles from being put in a space between the tub and the drum; and a support member configured to prevent the lip from drooping to prevent an interruption between the lip and the drum, wherein the support member comprises a reinforcement rib formed on an inner circumference of the tub to support an inner lateral side of the lip.

2. The tilted drum washing machine as claimed in claim 1, wherein the reinforcement rib is plurally formed to leave a predetermined interval from each other.

3. The tilted drum washing machine as claimed in claim 1, wherein the reinforcement rib is formed to leave a predetermined distance from the inner lateral side of the lip.

4. The tilted drum washing machine as claimed in claim 1, wherein the reinforcement rib is formed integral with the tub.

5. The tilted drum washing machine as claimed in claim 1, wherein the lip is formed along the entire inner circumference of the gasket.

6. The tilted drum washing machine as claimed in claim 1, wherein the lip is uniformly shaped along the entire inner circumference of the gasket.

7. A tilted drum washing machine comprising:

a cabinet having an entrance at a front side for inputting/outputting laundry;

a door opening/closing the entrance;

a tub slantingly installed in the cabinet to hold water;

a drum in the tub to hold a detergent and the water;

a gasket between the door and the tub, the gasket bringing the door watertight to prevent the water from leaking outside;

a lip extending radially inward from an interior side of the gasket around an inner circumference of the gasket to prevent particles from being put in a space between the tub and the drum; and a support member configured to prevent the lip from drooping to prevent an interruption between the lip and the drum, wherein the support member comprises a protrusion formed on an inner lateral side of the lip to be contacted with the tub.

8. The tilted drum washing machine as claimed in claim 7, wherein the protrusion is formed at a tip of the lip.

9. The tilted drum washing machine as claimed in claim 7, wherein the protrusion is plurally formed to leave a predetermined interval from each other.

10. The tilted drum washing machine as claimed in claim 7, wherein the protrusion is formed to leave a predetermined distance from the tub.

11. The tilted drum washing machine as claimed in claim 7, wherein the protrusion is formed integral with the lip.

12. The tilted drum washing machine as claimed in claim 7, wherein the lip is formed along the entire inner circumference of the gasket.

13. The tilted drum washing machine as claimed in claim 7, wherein the lip is uniformly shaped along the entire inner circumference of the gasket.

14. A gasket assembly of a tilted drum washing machine, comprising:

a gasket between a tub slantingly installed in a cabinet and a door installed at a front side of the cabinet, the gasket bringing the door watertight to prevent water from leaking outside;

a lip extending radially inward from an interior side of the gasket around an inner circumference of the gasket to prevent particles from being put in a space between the tub and the drum; and a support member configured to prevent the lip from drooping to prevent an interruption between the lip and the drum, wherein the support member comprises a reinforcement rib formed on an inner circumference of the tub to support an inner lateral side of the lip.

15. The gasket assembly of the tilted drum washing machine as claimed in claim 14, the gasket comprising:

a first plane portion coupled to the cabinet;

a second plane portion coupled to the tub; and a bending portion connecting the first plane portion to the second plane portion.

16. The gasket assembly of the tilted drum washing machine as claimed in claim 14, wherein the lip is uniformly shaped along the entire inner circumference of the gasket.

17. A gasket assembly of a tilted drum washing machine, comprising:

a gasket between a tub slantingly installed in a cabinet and a door installed at a front side of the cabinet, the gasket bringing the door watertight to prevent water from leaking outside;

a lip extending radially inward from an interior side of the gasket around an inner circumference of the gasket to prevent particles from being put in a space between the tub and the drum; and a support member configured to prevent the lip from drooping to prevent an interruption between the lip and the drum, wherein the support member comprises a protrusion formed on an inner lateral side of the lip to be contacted with the tub.

18. The gasket assembly of the tilted drum washing machine as claimed in claim 17, the gasket comprising:

a first plane portion coupled to the cabinet;

a second plane portion coupled to the tub; and a bending portion connecting the first plane portion to the second plane portion.

19. The gasket assembly of the tilted drum washing machine as claimed in claim 17, wherein the lip is uniformly shaped along the entire inner circumference of the gasket.

* * * * *